United States Patent [19]

Fantuzzo

[11] 4,087,169

[45] May 2, 1978

[54] TRANSFER ROLLER SYSTEM

[75] Inventor: Joseph Fantuzzo, Webster, N.Y.

[73] Assignee: Xerox Corporation, Stamford, Conn.

[21] Appl. No.: 737,821

[22] Filed: Nov. 1, 1976

Related U.S. Application Data

[63] Continuation of Ser. No. 631,987, Nov. 14, 1975, abandoned.

[51] Int. Cl.[2] ..... G03G 15/00

[52] U.S. Cl. ..... 355/3 TR; 100/171; 101/216; 101/DIG. 13; 118/638

[58] Field of Search ..... 355/3 TR, 3 TE, 3 R; 100/171, 176; 101/216, DIG. 13; 96/1.4; 118/638

[56] References Cited

U.S. PATENT DOCUMENTS

| | | | |
|---|---|---|---|
| 3,198,648 | 8/1965 | Trimbur | 101/DIG. 13 |
| 3,614,927 | 10/1971 | Jurny | 101/148 |
| 3,748,996 | 7/1973 | Kobayashi | 355/10 X |
| 3,751,156 | 8/1973 | Szostak et al. | 355/3 TR |
| 3,842,800 | 10/1974 | Hoffman | 96/1.4 X |
| 3,848,204 | 11/1974 | Draugelis | 355/3 R |
| 3,901,186 | 8/1975 | Hoffman et al. | 118/638 |

*Primary Examiner*—Richard L. Moses
*Attorney, Agent, or Firm*—Earl T. Reichert

[57] ABSTRACT

A constant force spring apparatus is used to bias a transfer roller into contact with a photoreceptor during movement of the latter, so that the force between the transfer roller and the photoreceptor remains constant regardless of any variations in the dimensions of the transfer roller or photoreceptor, or of any disturbances within the machine.

4 Claims, 3 Drawing Figures

TRANSFER ROLLER SYSTEM

This is a continuation of application Ser. No. 631,987, now abandoned, filed 11/14/75.

BACKGROUND OF THE INVENTION

The present invention relates to an improved transfer roller system for an electrostatic reproduction machine. More particularly, the invention is directed to apparatus for biasing a transfer roller into contact with a photoreceptor with a force which does not vary during operation of the machine.

In conventional xerography, a xerographic plate or photoreceptor comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the original pattern. The latent image is then developed by contacting it with a finely divided electrostatically attractable powder referred to an "toner". Toner is held on the image areas by the electrostatic charge on the surface. Where the charge is greater, a greater amount of toner is deposited. Thus, a toner image is produced in conformity with a light image of the copy being reproduced. The developed image is then transferred to a suitable transfer member (e.g., paper), and the image is affixed thereto to form a permanent record of the original document. Residual toner is then removed from the photosensitive surface prior to charging the surface again.

Where an electrically biased transfer roller is used to effect transfer of the developed image from the photoreceptor to the transfer member, problems often arise because of the force which biases the roller into contact with the photoreceptor.

One of the problems that arise in transfer roller systems is defects in copy quality, e.g., "hollow characters" which may result from a sheet of paper being subjected to an excessive pressure as it passes between the transfer roller and the photosensitive surface during the transfer step.

Another copy quality problem which sometimes arises in transfer roller systems relates to undesired nonuniform densities in the transferred image. This results from variations in pressure caused by variations in the dimensions of the photoreceptor or transfer roll diameter, or disturbances within the reproduction machine.

SUMMARY OF THE INVENTION

A primary object of the present invention is the elimination of the problems described above which relate to the force with which a transfer roller is biased into contact with the photoreceptor of an electrostatic reproduction machine. To effect this object, a transfer roller is mounted to pivot about an axis so that the roll can move in a direction which is at least generally perpendicular to the photoreceptor at the point of contact. A first set of negator (constant load) springs are used to offset the weight of the transfer roller mechanism about its pivotal axis. A second set of negator springs are adjustably mounted so that they can be moved to apply a force at a desired point on either side of the pivotal axis.

DESCRIPTION OF THE INVENTION

Figure 1:
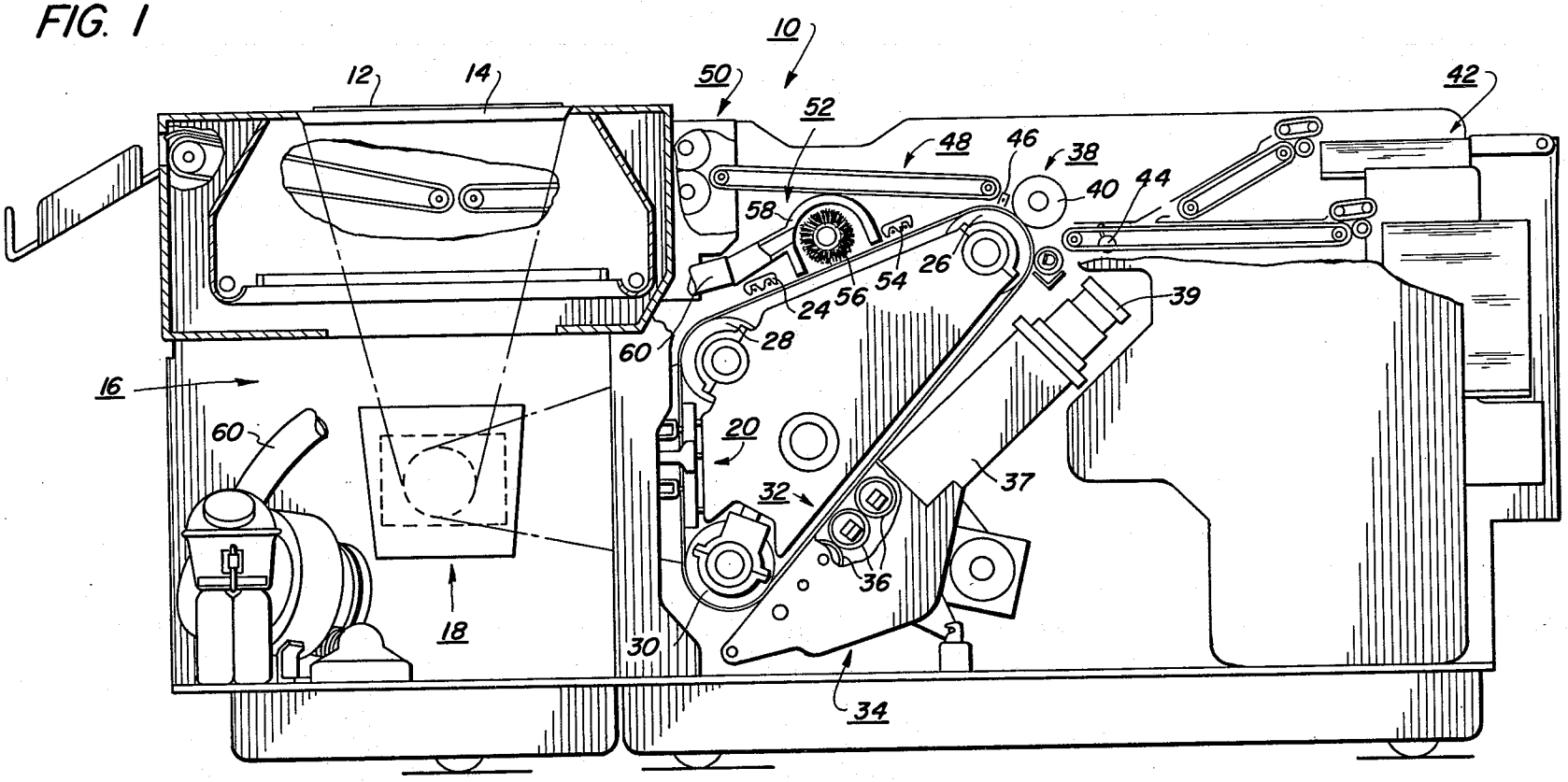
FIG. 1 is a schematic sectional view of an electrostatic reproduction machine embodying the principles of the present invention.

For a general understanding of an electrostatic reproduction machine in which the present invention may be incorporated, reference is made to FIG. 1. As in all electrostatic reproduction machines of the type illustrated, a light image of an original is projected onto the photosensitive surface of a xerographic plate to form an electrostatic latent image thereon. Thereafter, the latent image is developed with an oppositely charged developing material comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support platen 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately +900 volts by a corona generating device 24 located at a belt run extending between the belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes around the roller 30 and through a developing station 32 where a developing apparatus indicated generally by the reference numeral 34 is positioned. The developing apparatus 34 comprises a plurality of magnetic brushes 36 which carry developing material to the surface of the upwardly moving belt 22, and a toner dispenser 37 covered by a cap 39. As the developing material is applied to the belt, toner particles in the development material are electrostatically attracted to the charged photosensitive surface to form a powder image (an electrostatic developed image).

The developed electrostatic image is transported by the belt 22 to a transfer station 38 where a sheet of paper is moved at a speed in synchronism with the moving belt in order to effect transfer of the developed image.

Located at the transfer station 38 is a transfer roll 40 which is arranged on the frame of the machine to contact the back side of the sheet of paper as the latter is moved or fed between the belt and the transfer roll. The roll 40 is electrically biased with sufficient voltage so that the developed image on the belt may be electrostatically attracted to the adjacent side of a sheet of paper as the latter is brought into contact therewith.

A suitable sheet transport mechanism transports sheets of paper seriatim from a paper handling mechanism indicated generally by the reference numeral 42 to the developed image on the belt as the same is carried around the roller 26. In passing from the paper handling mechanism to the transfer roll 40, each sheet contacts a plurality of registration fingers 44 which serve to actuate various components within the machine at the proper time during passage of each sheet through the machine.

As a sheet emerges from the transfer station 38, a charge is deposited thereon by a detack corona generating device 46 to lessen the electrostatic attraction between the belt 22 and the sheet so that the latter can be removed by a vacuum stripping and transport mechanism 48. The sheet is thereafter retained on the underside of the vacuum stripping transport mechanism 48 for movement into a fuser assembly indicated generally by the reference numeral 50 wherein the powder image on the sheet is permanently affixed thereto. After fusing, the finished copy is discharged at a suitable point for collection. The toner particles remaining as residue on the belt 22 are carried by the belt to a cleaning apparatus 52. The cleaning apparatus 52 comprises a corona discharge device 54 for neutralizing charges remaining on the untransferred toner particles, a rotating brush 56 mounted within a housing 58, and a vacuum outlet 60.

Figure 2:
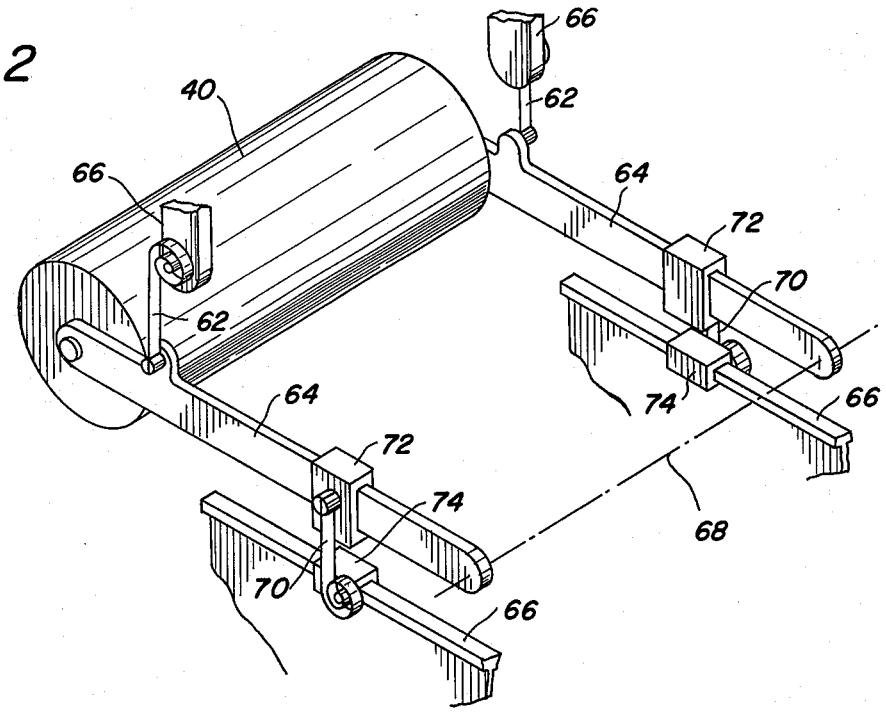
FIG. 2 is a perspective schematic view of the improved roller system.
Figure 3:
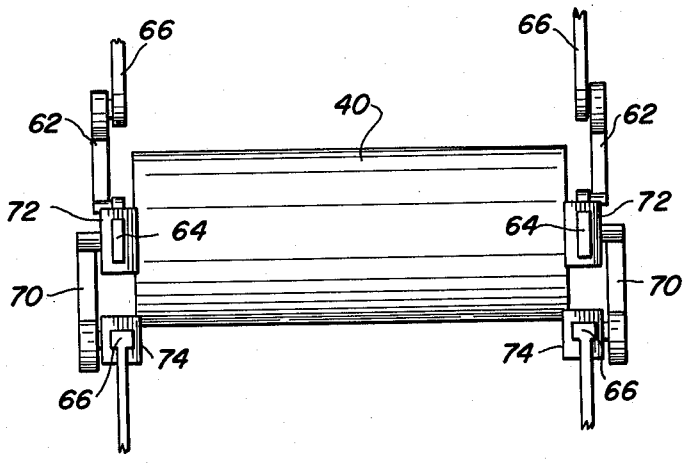
FIG. 3 is a cross-sectional view taken through line 3—3 of FIG. 2.

Referring to FIGS. 2 and 3, the present invention will be described in detail. A first set of negator (constant load) springs 62 are attached to each of supporting arms 64 and to the frame 66 of the machine 10 to offset the weight of the transfer roller mechanism about its pivotal axis 68. Thus, the transfer roller system is balanced or nearly balanced by the springs 62.

A second set of negator springs 70 are connected to members 72 which are slidably mounted on the arms 64, and to members 74 which are slidably mounted on the frame 66. Members 72 and 74 can both be locked in a desired location on either side of the pivotal axis 68 by set screws (not shown) or any other suitable means. Thus, as can be seen, once the weight of the transfer roller mechanism is balanced by springs 62, the position of the springs 70 is finely adjusted to produce the moment about pivotal axis 68 which results in the exact load at the point of contact between the photoreceptor 22 and the transfer roller 40 which is necessary to effect optimum transfer. Once this load is set, it remains constant during the operation of the machine regardless of variations in the dimensions of the photoreceptor 22 or transfer roller 40, or of disturbances within the machine.

While the invention has been described with reference to the structure disclosed, it is not confined to the details set forth, but is intended to cover such modifications or changes as may come within the scope of the following claims.

What is claimed is:

1. An improved combination of a photoreceptor mounted for movement around a closed path and a transfer roller system for transferring a developed electrostatic image from the photoreceptor to a transfer member, the transfer roller system including a transfer roller in contact with the photoreceptor, and means for mounting the roller to pivot about an axis so that the roller can move in a direction which is at least generally perpendicular to the surface of the photoreceptor, wherein the improvement comprises means including a negator spring for maintaining the roller in contact with the photoreceptor with a force which is constant regardless of any pivotal movement of the roller during movement of the photoreceptor around the closed path.

2. An improved transfer roller system for transferring a developed electrostatic image from a photoreceptor mounted for movement around a closed path to a transfer member, the system including a transfer roller, and means for mounting the roller to pivot about an axis so that the roller can move in a direction which is at least generally perpendicular to the surface of the photoreceptor, Wherein the improvement comprises means for biasing the roller into contact with the photoreceptor with a force which is constant regardless of any pivotal movement of the roller during movement of the photoreceptor around the closed path, the biasing means including first means for creating a moment about the pivotal axis which is equal to but opposite in direction to the moment created by the weight of the transfer roller and mounting means, and second means adjustably connected to the mounting means for creating a predetermined moment about the pivotal axis.

3. An improved transfer roller system according to claim 2, wherein the second means is slidably mounted on the mounting means.

4. An improved transfer roller system according to claim 3, wherein the first and second means each include a constant force spring.

* * * * *